US006311781B1

(12) United States Patent
Jerke

(10) Patent No.: US 6,311,781 B1
(45) Date of Patent: Nov. 6, 2001

(54) BALLAST TANK FOR EXCAVATING EQUIPMENT

(75) Inventor: Richard E. Jerke, Cranbrook (CA)

(73) Assignee: Karic Ventures Ltd., Cranbrook ( * ) Notice: Subject to any disclaimer, the term of this patent is extended or adjusted under 35 U.S.C. 154(b) by 0 days.

(21) Appl. No.: 09/541,770

(22) Filed: Apr. 3, 2000

(51) Int. Cl.[7] ..... A62C 3/07; B05B 15/06

(52) U.S. Cl. ..... 169/62; 169/70; 239/172; 239/289

(58) Field of Search ..... 169/52, 54, 62, 169/70; 239/146, 149, 172, 722, 289; 37/403, 241; 111/118, 127, 129

(56) References Cited

U.S. PATENT DOCUMENTS

| | | | | |
|---|---|---|---|---|
| 2,946,598 | * | 7/1960 | Foster . | |
| 3,016,201 | | 1/1962 | Brogden . | |
| 3,055,594 | | 9/1962 | Nansel . | |
| 3,169,581 | * | 2/1965 | Cummins . | |
| 3,396,983 | * | 8/1968 | Massey et al. | 239/172 X |
| 3,785,439 | * | 1/1974 | Britt | 169/62 |
| 4,062,407 | * | 12/1977 | Bentrup | 169/47 |
| 4,250,869 | * | 2/1981 | Doyle . | |
| 4,811,796 | * | 3/1989 | Allen | 169/62 |
| 5,199,196 | | 4/1993 | Straley . | |
| 5,301,756 | | 4/1994 | Relyea et al. . | |
| 5,788,158 | | 8/1998 | Relyea . | |
| 6,053,256 | * | 4/2000 | Lu | 169/54 X |
| 6,095,251 | * | 8/2000 | Mitchell et al. | 169/54 X |

* cited by examiner

*Primary Examiner*—Lesley D. Morris
(74) *Attorney, Agent, or Firm*—Kolisch Hartwell; Dickinson McCormack & Heuser

(57) ABSTRACT

A tank for an excavator vehicle having a frame and body with a hydraulically operated bucket and an engine, the tank comprising a main body mountable to the frame adjacent the engine. The main body has a sealed interior volume with at least one ballast region formed within the interior volume to hold fluid for ballast and at least one discharge region formed within the interior volume to hold fluid for discharge from the tank. There is also at least one valve communicating the ballast region with the discharge region to permit one way flow from the ballast region to the discharge region. A pump having an inlet communicates the discharge region with an outlet. A conduit extends from the pump outlet for delivering fluid forwardly of the excavator bucket. The tank provides ballast for stabilizing the excavator and fluid for fire fighting purposes making the tank useful in fire fighting situations where simultaneous delivery of pressurized fluid and penetration and removal of burning debris is desirable. Such work often occurs in forest fires or at building sites where some or all of the building structure has collapsed. To work in such conditions requires a vehicle that is able to operate safely in close proximity to heat and flames and that is stable and able to maneuvering over terrain strewn with debris.

15 Claims, 7 Drawing Sheets

BALLAST TANK FOR EXCAVATING EQUIPMENT

BACKGROUND OF THE INVENTION

1. Field of the Invention

The present invention relates to a ballast tank mountable to an excavator. More particularly, the present invention relates to a tank mountable to excavating equipment for holding fluid for both ballast and fire fighting purposes.

2. Description of Related Art

Vehicles adapted for delivery of pressurized fluids are well known and widely used in fire fighting, agriculture and construction site applications. Movable vehicles are practical for applications requiring mobility and delivery of large volumes of fluid under pressure.

The majority of fire fighting vehicles are highly specialized and designed with large storage fluid tanks and high pressure pumps to deliver fluid to a fire from a relatively safe distance. Examples of such vehicles can be found in U.S. Pat. No. 5,301,756 granted on Apr. 12, 1994 to Robert G. Relyea for a "Vehicle Mounted Aerial Lift", and U.S. Pat. No. 5,788,158 granted on Aug. 4, 1998 to Robert G. Relyea for an "Automatic Leveling Fluid Nozzle for Aerial Boom".

Other designs known to the inventor for general fluid spraying equipment mountable to a vehicle include U.S. Pat. No. 5,199,196 granted on Apr. 6, 1993 to Paul M. Straley for an "Earth Grading Soil Compaction Tractor with Water Spray Capability", U.S. Pat. No. 3,016,201 granted on Jan. 9, 1962 to Oren D. Brogden for a "Tunnel Cleaning Machine" and U.S. Pat. No. 3,055,594 granted on Sep. 25, 1962 to Harold K. Nansel for a "Boom-Type Spraying Means".

There exist applications where it is desirable for a fire fighting vehicle to be able to get close to the fire. For example, in some cases, simultaneous delivery of pressurized fluid and penetration and removal of burning debris is desirable. Such work often occurs in forest fires or at building sites where some or all of the structure has collapsed. To work in such conditions requires a vehicle that is able to operate in the extreme heat adjacent a fire and that is stable and able to maneuvering over terrain strewn with debris.

Existing excavating equipment equipped with hydraulically operated buckets at the end of manipulating arms function well to remove debris, however, such equipment is not designed to carry large volumes of fluid for fire fighting nor is it designed to operate in the very hot environment in the vicinity of a fire.

SUMMARY OF THE INVENTION

The present invention is directed to a solution to the problems discussed above. Rather than design a new fire fighting vehicle from scratch, I have developed a multipurpose tank that is retro-fittable to existing excavating equipment to function as a ballasting means and to provide fluid under pressure for fire fighting operations.

Accordingly, the present invention provides a tank for an excavator vehicle having a frame and body with a hydraulically operated bucket and an engine, the tank comprising:

a main body mountable to the frame adjacent the engine, the main body having a sealed interior volume;

at least one ballast region formed within the interior volume to hold fluid for ballast;

at least one discharge region formed within the interior volume to hold fluid for discharge from the tank;

at least one valve communicating the at least one ballast region with the at least one discharge region to permit one way flow from the ballast region to the discharge region;

a pump having an inlet in communication with the discharge region and an outlet; and a conduit extending from the pump outlet for delivering fluid forwardly of the excavator bucket.

In a preferred embodiment, the tank of the present invention includes an additional sealed compartment adapted to retain a fire retardant material, the additional compartment including an outlet in communication with the flexible hose for delivering fluid forwardly of the excavator bucket to mix the fire retardant material with the fluid.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION OF THE PREFERRED EMBODIMENTS

Figure 1:
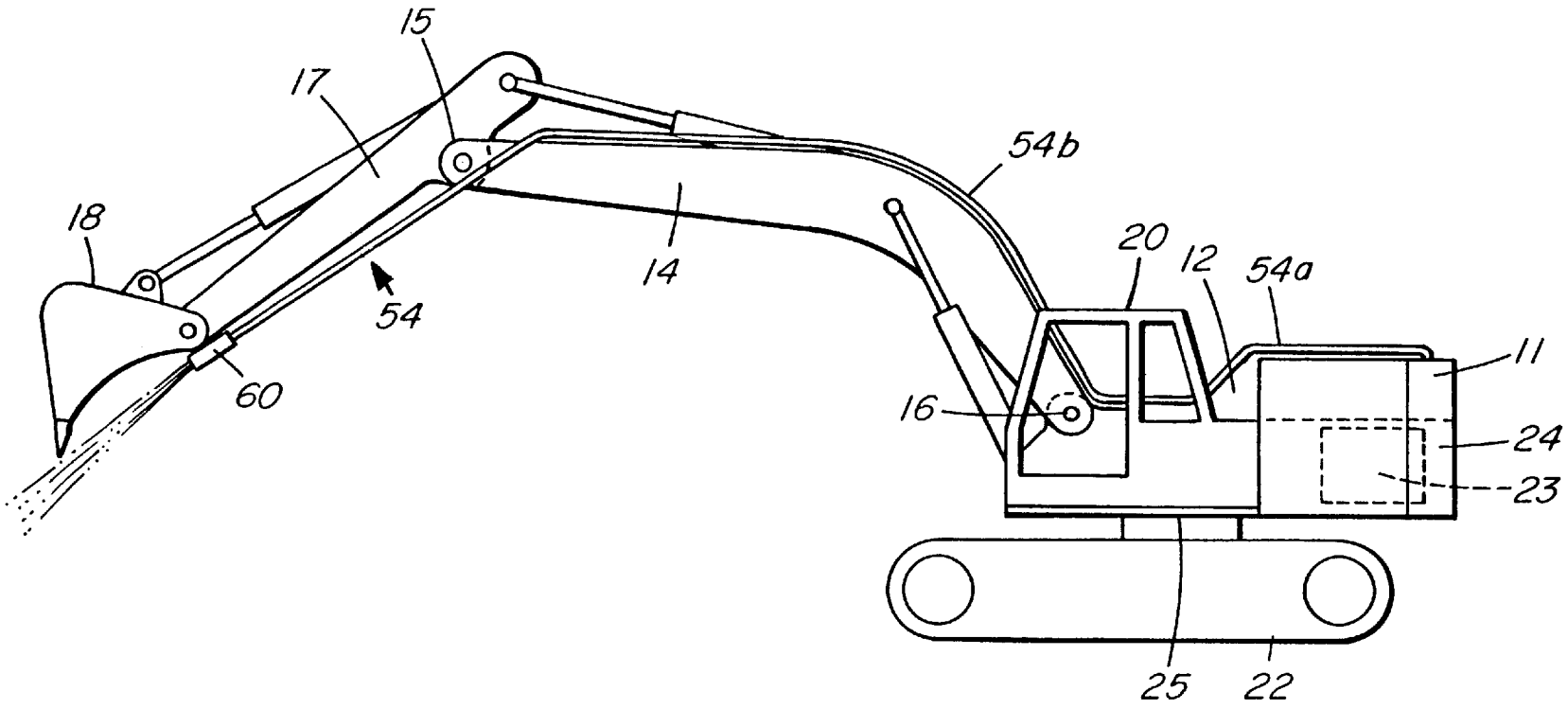
FIG. 1 is a perspective view of an excavator fitted with a tank according to a preferred embodiment of the present invention.

An excavator vehicle 12 fitted with the tank 11 of the present invention is illustrated in FIG. 1. The excavator vehicle 12 has a cab 20 mounted on a frame 25. An articulated arm 14 is pivotally mounted at point 16 to the frame and extends forwardly therefrom. Arm 14 has an additional pivot point 15 intermediate its length and terminates in an excavating bucket 18. A pair of caterpillar tracks 22 allow the excavator to move over rough ground. The excavator is rotatably mounted to the frame 25. An engine 23 is positioned rearwardly of cab 20 to provide power.

Figure 2:
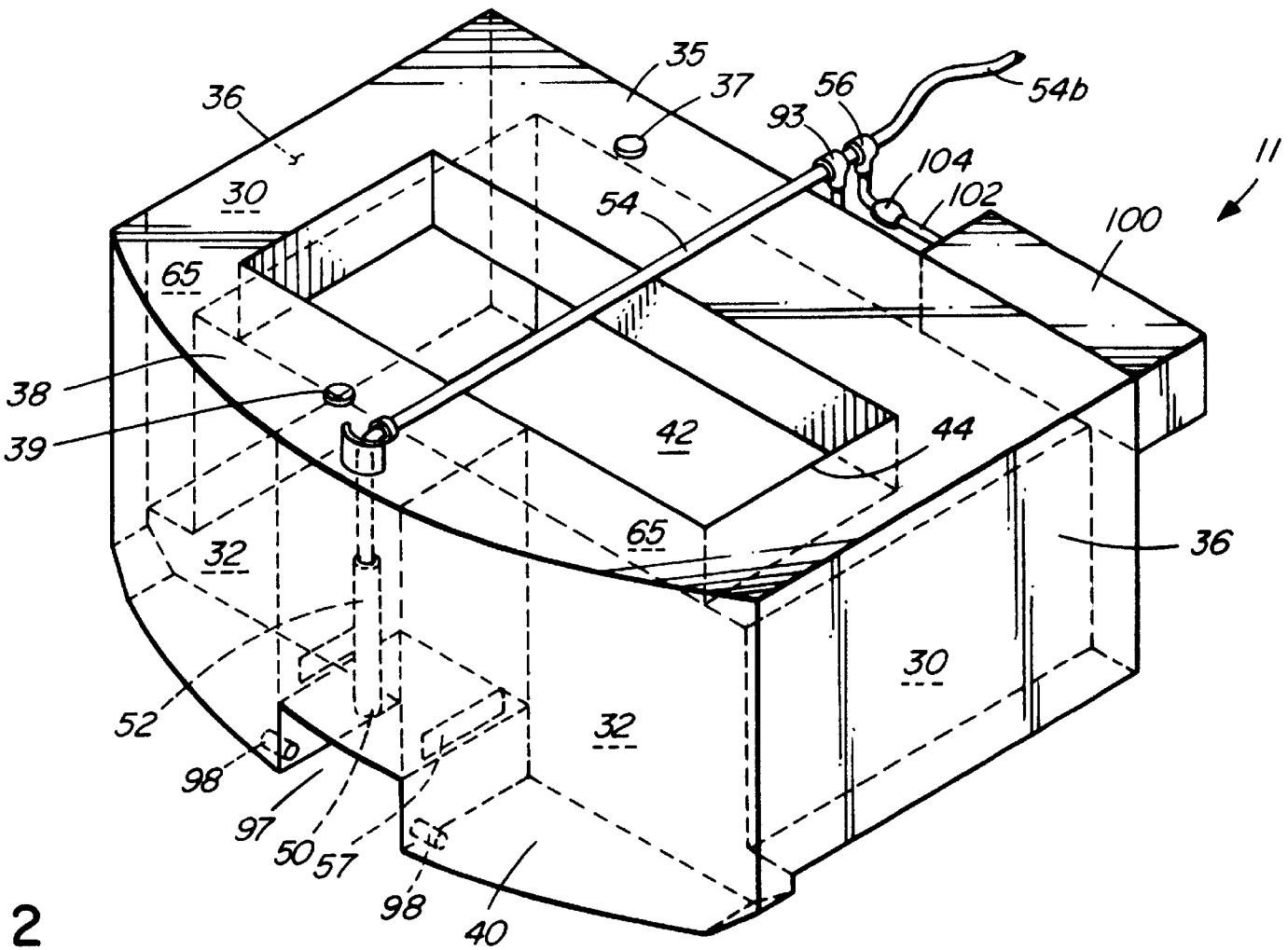
FIG. 2 is a perspective view of the tank of FIG. 1 from the rear.
Figure 3:
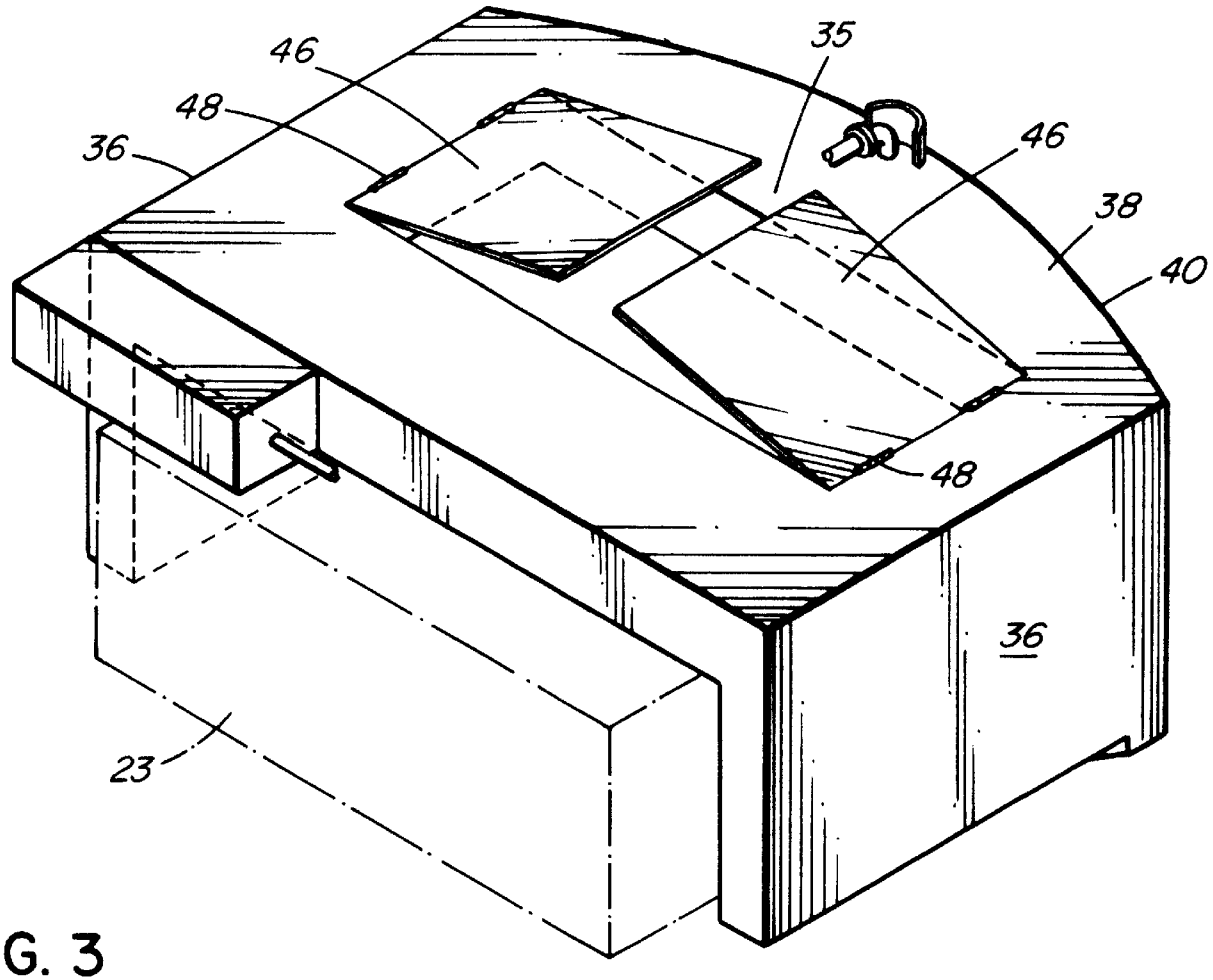
FIG. 3 is a simplified perspective view of the tank from the front.

As best shown in FIGS. 2 and 3, the tank 11 of the present invention comprises a main body mountable to frame 25 adjacent engine 23. The main body is preferably formed from a series of welded steel plates to define a sealed interior volume. The interior volume is divided into at least one ballast region 30 to hold fluid for ballast and at least one discharge region 32 to hold fluid for discharge from the tank under pressure. While regions 30 and 32 have conveniently been labeled "ballast" and "discharge" regions, respectively, it will be appreciated that both regions inherently act as ballast due to the weight of the tank plates and the weight of the fluid within each region.

Tank 11 is advantageously mounted towards the rear of the excavator vehicle 12 and has sufficient fluid capacity to operate as a ballasting device to increase the stability of the excavator vehicle in operations requiring excavation of burning debris with the bucket 18. Conventionally, excavator vehicles are provided with removable ballast in the form of concrete weights that are attached at the rear of the vehicle. Different weights can be attached depending on ballast necessary to stabilize the vehicle. The tank 11 of the present invention replaces these weights and makes them unnecessary.

As best shown in FIG. 3, tank 11 is adapted to fit about engine compartment 23 which is shown by a cross-hatched cube to delimit the general volume of the compartment. Preferably, tank 11 is formed in cross-section as an inverted U with uppermost central web portion 35 that extends between two downwardly extending legs 36. Legs 36 are positionable on opposite sides of the engine compartment to straddle the compartment such that central portion 35 extends over top the engine. Legs 36 and connecting central web portion 35 are hollow and define the ballast region 30 of the tank. A sealable inlet 37 is provided in central web portion 35 to allow fluid to be introduced into ballast region.

An end portion 38 extends across the downwardly extending legs 36 at the rear of the inverted U tank to enclose and cover that end. The end portion 38 has a generally rounded outer side wall 40. In the illustrated embodiment, the hollow interior of end portion 38 defines the discharge region 32 of the tank. A separate inlet 39 is formed in the top surface of end portion 38.

Legs 36, central web portion 35 and end portion 38 surround on three sides an open central region 42 positionable over the engine to enclose the engine at the top, sides and at one end in order to cover and protect the engine from the heat and burning ash of a fire. Although the tank is illustrated substantially as a generally U-shaped body to perform its protective function, those skilled in the art will recognize that various other shapes are possible as long as the engine compartment is substantially enclosed.

To permit access to the engine compartment 32 for routine maintenance such as oil changes or spark plug changes, there is a central opening 44 through central web portion 35. As best illustrated in FIG. 3, the central opening 44 is covered by a pair of perforated hinged covers 46. The covers 46 are hinged to tank 11 by hinges 48 adapted to permit opening of the covers to the position shown in FIG. 3 to provide useful access to the engine compartment 23.

Figure 4:
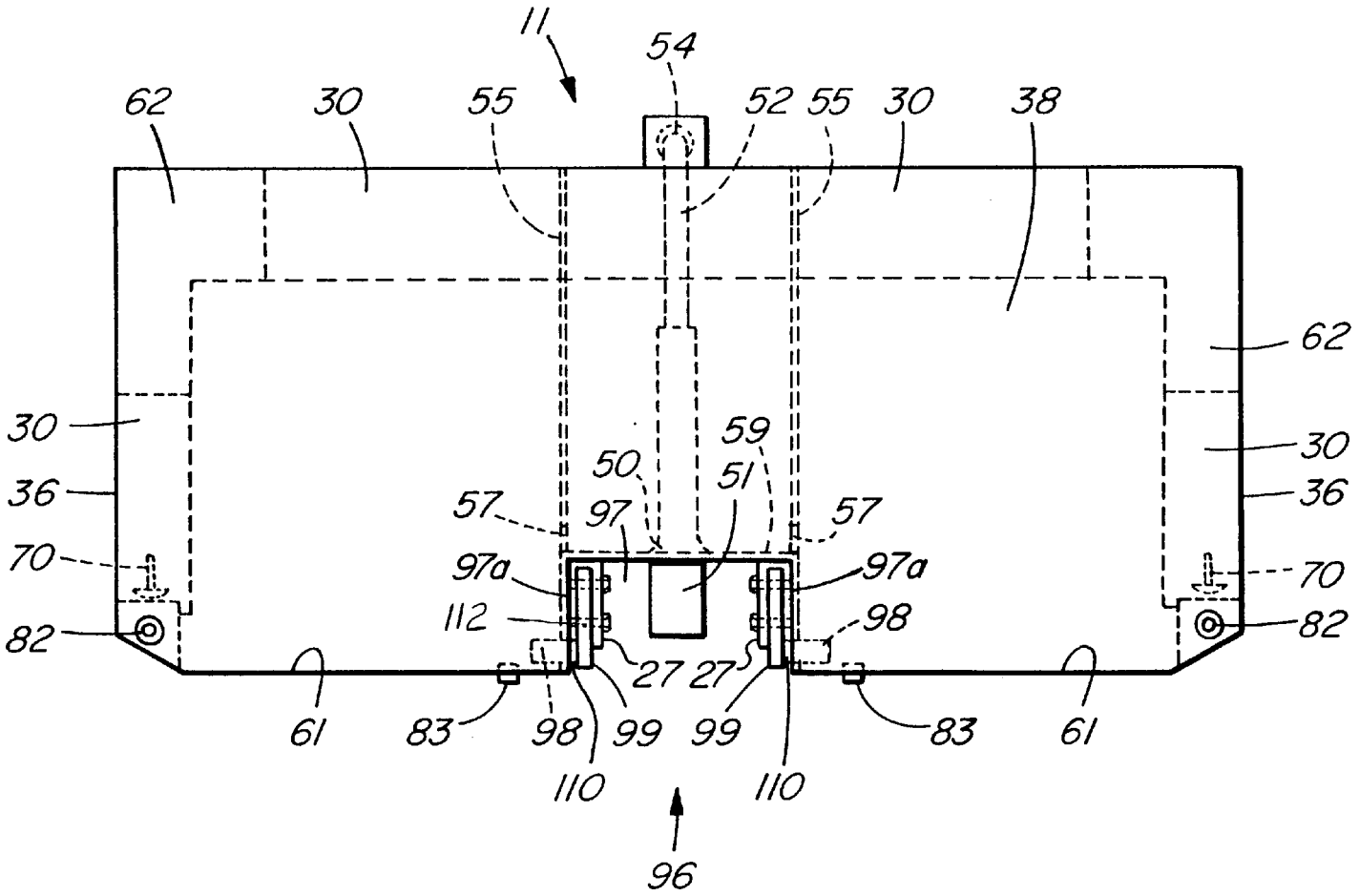
FIG. 4 is a rear end elevation of the tank of FIG. 1.

Referring to FIGS. 2 and 4, end portion 38, which defines discharge region 32, includes a centrally positioned pump 50. Pump 50 has an inlet in communication with discharge region 32 and an outlet that directs fluid under pressure via a riser pipe 52 to a conduit 54 that extends from tank 11 to deliver fluid forwardly of excavator bucket 18. Pump 50 is preferably a hydraulic pump which is driven hydraulic motor 51 external to the discharge tank. It will be apparent to a person skilled in the art that other types of pumps can be used in the discharge region 32. Preferably, pump 50 is a high capacity pump that is able to discharge fluid at a rate of approximately 15 gallons/minute at 300 psi pressure.

To strengthen and brace end portion 38, plates 55 extend within discharge region 32 on either side of pump 50. Lower openings 57 in plates 55 permit fluid flow to the pump. Plates 55 also act as partitions to limit the tendency of fluid in the discharge region to move or "slosh" within the tank while the excavator is moving. This is important to prevent shifting of large volumes of fluid in the discharge region 32 which could adversely affect the stability of the excavator.

In the arrangement illustrated in FIG. 4, pump 50 can be provided with inlet pipes that extend from the raised surface 59 on which the pump is mounted to the floors 61 of end portion 38 to provide the capability for the pump to scavenge all the fluid in the discharge region 32.

Figure 6:
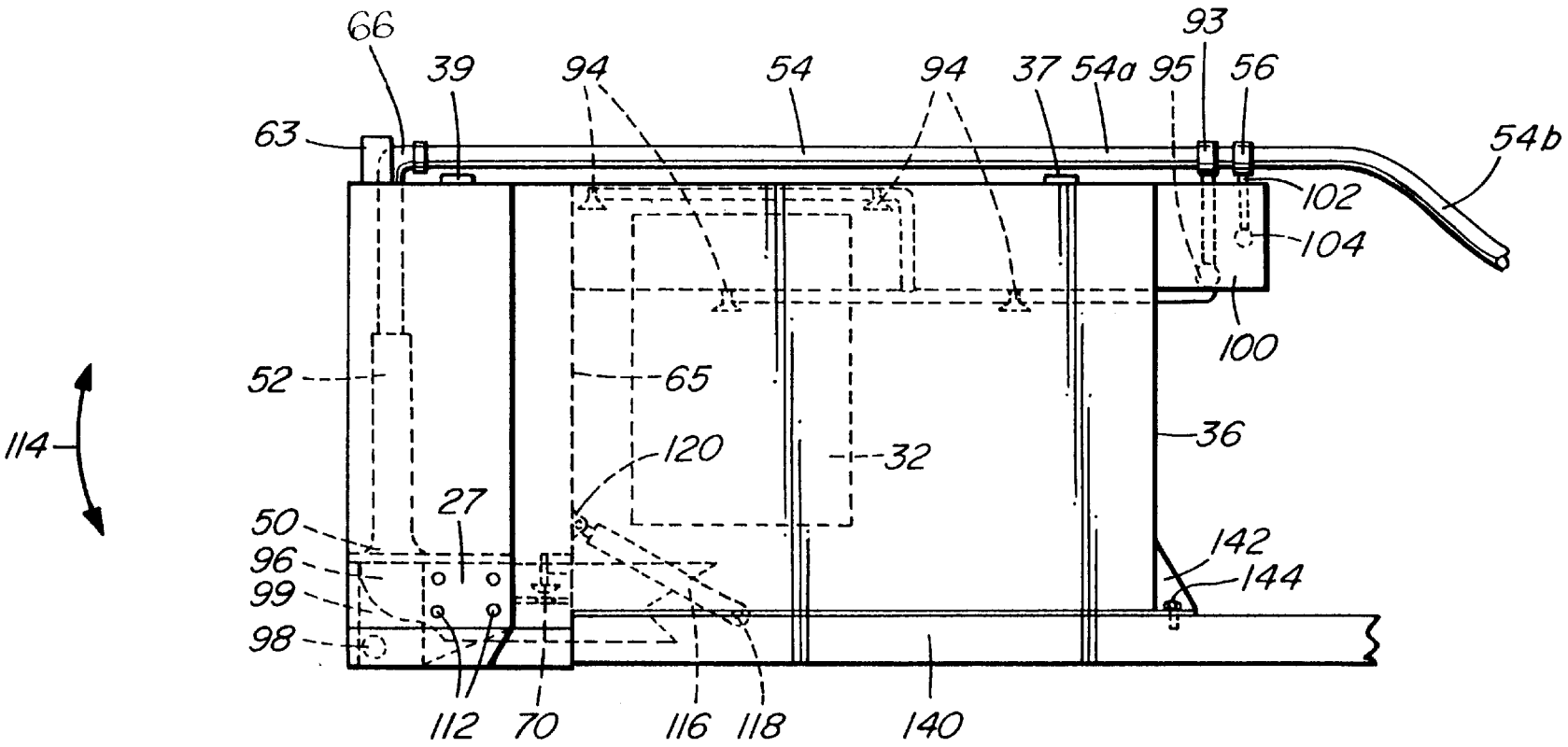
FIG. 6 is a side elevation view of the tank.

As best shown in FIGS. 1 and 6, conduit 54 for delivering fluid from pump 50 is preferably formed from a series of rigid pipe sections coupled to flexible hose sections to accommodate pivoting movement of articulated arm 14. For example, as shown in FIG. 6, the section 54*a* extending from the end of riser pipe 52 to coupling 56 is a rigid pipe. Since the L-shaped pipe section 55 protruding from tank end portion 38 may be vulnerable to mechanical damage, a protective shield 63 is preferably mounted adjacent the pipe. At coupling 56, rigid pipe 54*a* is joined to flexible hose 54*b* which is able to flex to permit movement of arm 14 at pivot point 16. Hose portion 54*b* is made from a fire retardant material in order to function in the vicinity of a fire. Along the length of arm 14, there are rigid sections 54*a* to anchor the conduit 54 to the arm so that the conduit moves with the arm and flexible sections 54*b* adjacent pivoting points. Conduit 54 terminates at a nozzle 60 mounted adjacent excavator bucket 18. Nozzle 18 can be mounted directly to the excavator bucket or to segment 17 of arm 14. Preferably, nozzle 60 is positioned such that fluid under pressure from the nozzle is directed at objects directly in front of the bucket.

Figure 5:
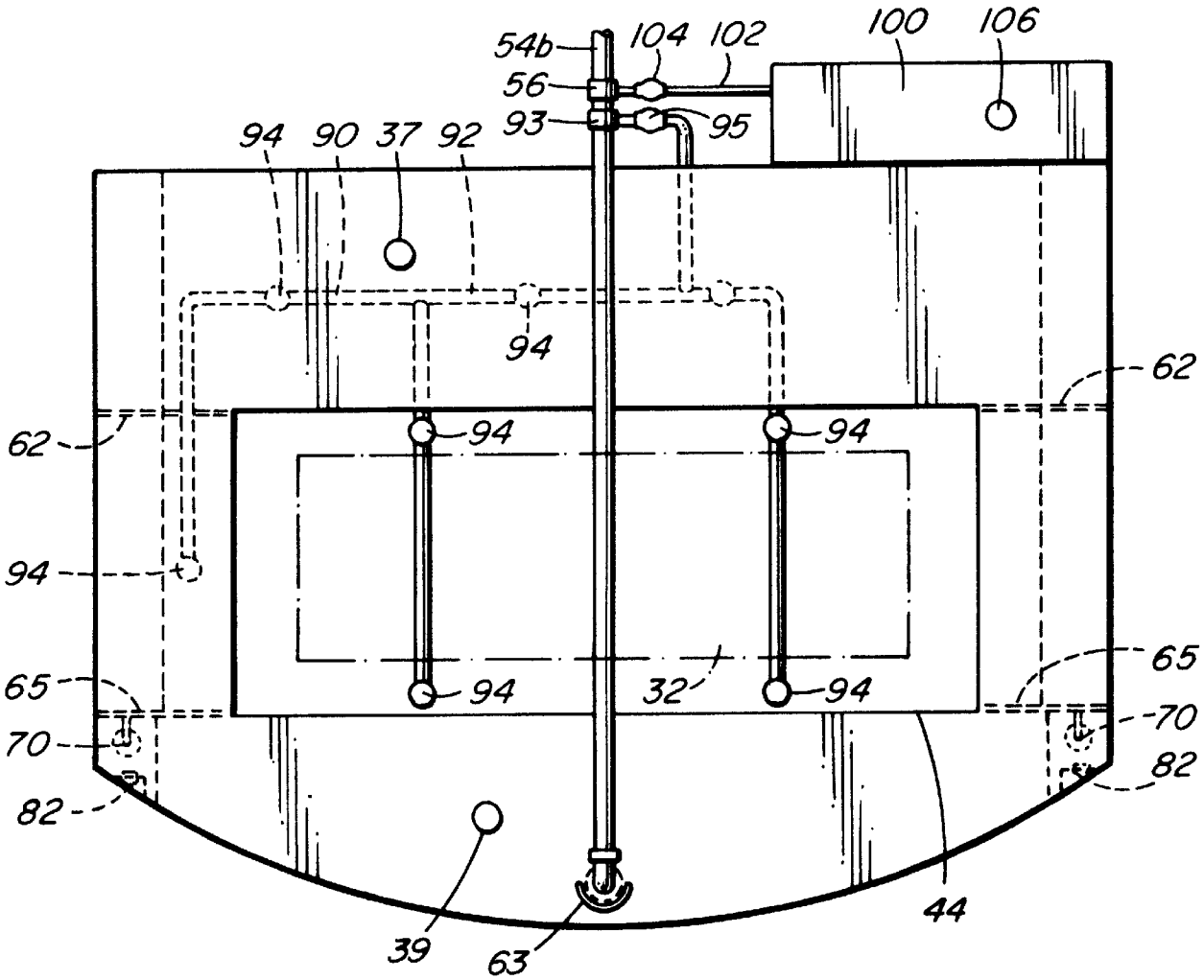
FIG. 5 is a plan view of the tank.

FIG. 4 is a rear end view and FIG. 5 is a top view of tank 11. These views are useful for showing the arrangement of the ballast regions 30 and the discharge region 32 of the tank. Ballast regions 30 occupy the downwardly extending legs 36 and the central web portion 35 of tank 11. To ensure the structural rigidity of the tank, a series of generally L-shaped gusset plates 62 are welded into the upper corners of legs 36 adjacent the front comers of opening 44 through the central web portion 35. Plates 62 also act as baffles or partitions that tend to limit movement or "sloshing" of the ballast water in region 30 during normal operation of the excavator.

Figure 7:
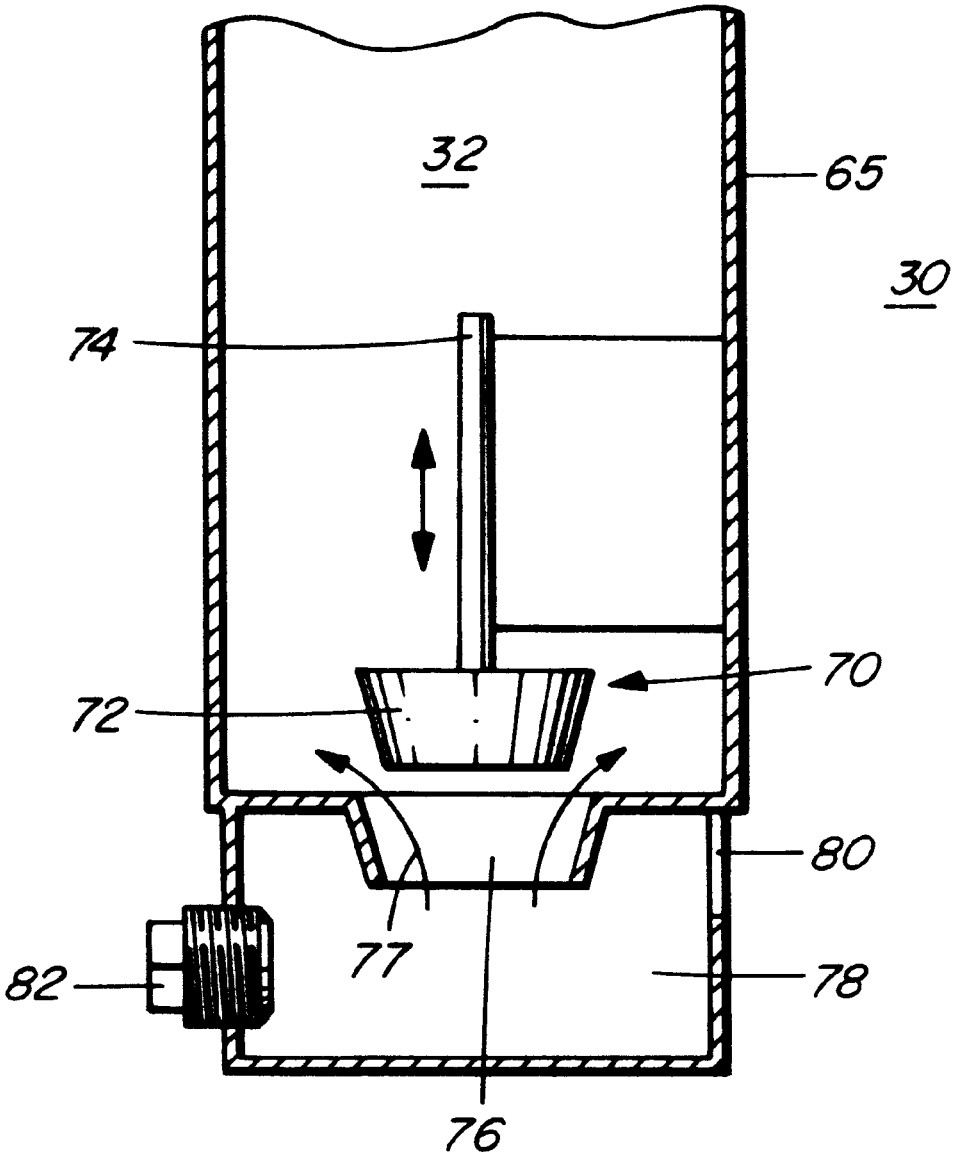
FIG. 7 is a detail view of the one-way valve.

Ballast regions 30 are separated from discharge region 32 by partitions 65 best shown in FIG. 5. These partitions divide and seal regions 30 and 32 into separate compartments. At least one valve communicates ballast region 30 with discharge region 32 across partition 65 to permit one way flow of fluid from the ballast region to the discharge region. In the illustrated embodiment, two valves 70 are provided to control the flow of fluid as best shown in FIGS. 5, 6 and 7. The valves are located at opposite sides of the tank at the lower outer edges of discharge region 30.

FIG. 7 is a detail view of the structure of valve 70. The valve 70 comprises a sealing member 72 that is mounted for vertical movement along post 74 which is rigidly mounted to partition 65. Sealing member 72 is positioned above a valve chamber 78 that extends between ballast chamber 30 and discharge chamber 32. Valve chamber 78 includes an inlet 80 that communicates with ballast region 30 and an outlet 76 that communicates with discharge region 32. Outlet 76 is sealed or opened by vertical movement of sealing member 72 on post 74. Outlet 76 and sealing member 72 are formed such that flow through outlet 76 is one way from valve chamber 78 to discharge region 32 in the direction shown by arrows 77. While a specific valve arrangement is shown in the Figures, it will be readily apparent to a person skilled in the art that an alternative one way valve such as a flap valve can be used.

A threaded drain plug 82 is provided to permit draining of the valve chamber 78 and ballast region 30. Similarly, as best shown in FIG. 4, threaded drain plugs 83 are formed in the base of end portion 38 to permit independent draining of discharge region 32.

Fluid in ballast region 30 is free to flow through inlet 80 into valve chamber 78. Only when the pressure in valve chamber 78 exceeds the pressure in discharge region 32 will valve 70 open to allow water to flow into discharge region 32. The pressure in discharge region 32 will decrease as pump 50 is operated to discharge fluid through conduit 54. In this fashion, fluid is supplied to discharge region 32 as needed from ballast region 30. This approach tends to minimize unnecessary movement or "sloshing" of fluid within a region of the tank or between regions to ensure maximum stability.

Referring to FIGS. 5 and 6, the tank of the present invention preferably includes a sprinkler system 90 to spray water under pressure to various regions of the engine compartment 32. Sprinkler system 90 comprises an additional conduit 92 in communication with pump 50 for delivering fluid as a spray over various areas of the engine. Preferably, conduit 92 extends downwardly and rearwardly from conduit 50 at coupling 93 to extend under central web portion 35 and into engine compartment 32. Conduit 92 branches into an array of various smaller diameter pipes that terminate in sprinkler heads 94 that are positioned adjacent engine compartment components such as the engine block, the radiator, battery, the oil pump, the fuel pump and the hydraulic lines. A valve 95 controls the flow of fluid through conduit 92 and to sprinkler heads 94. Valve 95 can be operated manually from the cab or a temperature sensor can be installed in engine compartment 32 to monitor the temperature and open valve 95 if the temperature rises above a pre-determined level.

Spraying fluid into engine compartment 32 has been found to lower the temperature in the compartment by 20–30° F. which improves the ability of the engine to operate in the very hot environment adjacent a fire. Also, the water spray produced by sprinkler heads 94 will tend to put out any fires that might be ignited in the engine compartment due to fly ash or other burning debris entering the engine compartment. This makes an excavator equipped with the tank of the present invention safer to operate in and around a fire.

Tank 11 is preferably mounted to the excavator via a pivoting joint 96 which is best shown in FIGS. 4 and 6. The main frame of the excavator is typically formed with rearwardly extending, spaced parallel arms 27. The base of end portion 38 is formed with a channel 97 having inside vertical edges 97*a* formed with recesses 98. Hinge plates 99 with outwardly extending pins 110 are mounted by a series of fasteners 112 to arms 27 of the main excavator frame. Pins 110 are rotatably received in recesses 98 to define an axis for pivoting of the tank. As best shown in FIG. 6, tank 11 pivots about pins 98 in the direction indicated by arrow 114 such that the front end of the tank is raised to clear engine compartment 32 to provide full access to the engine for major work without having to completely remove the tank. Of course, it is necessary to substantially drain regions 30 and 32 of the tank before attempting to pivot the tank about pins 98. When tank 11 is in the operating position illustrated, the base of legs 36 preferably rest on the cat walks 140 that extend about the framework of the excavator. In addition, the lower front ends of each leg 36 are formed with anchor plates 142 that can be fixed to the cat walk by fastener 144 to secure the tank in place.

To pivot the tank when fasteners 144 are released, an actuator in the form of a hydraulic cylinder 116 (FIG. 6) is preferably provided. Hydraulic cylinder 116 has an end 118 pivotally mounted to excavator frame 25 and an opposite end 120 pivotally attached to the inside face of end portion 38. As cylinder 116 is extended or shortened, tank 11 will pivot about pins 98.

As best shown in FIGS. 2 and 6, an auxiliary tank 100 can be mounted on the front end of tank 11. Auxiliary tank 100 is provided to hold a flame retardant, for example foam, that may be mixed with water from the discharge region 32 of the main tank 11 or dispensed alone for short period. Auxiliary tank 100 is connected to conduit 54 via line 102. A valve 104 in line 102 is controlled remotely from the cab of the excavator to allow the operator to control the amount of foam being delivered to conduit 54. An inlet 106 for material into the auxiliary tank is provided in the top surface of the tank for convenient filling.

A tank according to the illustrated embodiment of the invention manufactured from steel plate will weigh approximately 4,500 pounds empty. Ballast regions 30 can be filled to add approximately 4,000 pounds to the weight. Similarly, if discharge region 32 is filled, the tank will increase in weight by a further 4,000 pounds. By filling the ballast regions 30 and the discharge region 32 with a fluid to different levels, a desired weight distribution in the tank can be initially established. As fluid is discharged, the tank will become lighter.

Operation

With reference now to FIGS. 1, 2 and 3, the operation of an excavator equipped with the tank 11 of the present invention will now be described. Tank 11 has been filled to capacity with water and conduit 54 is fully extended with nozzle 60 directed towards the fire by appropriate positioning of articulated arm 14.

To begin pumping of water, the operator switches on pump 50 to move water from discharge region 32 into conduit 54 for discharge through nozzle 60. The water can be directed at a particular area of a fire by manipulation of arm 14 to assist in fire fighting efforts. In addition, in operation in a forest fire, bucket 18 of the excavator can be used to dig up underground fires and break up burning debris. Prior to material being loaded into bucket 18, it can be doused with water from nozzle 60 to extinguish burning material or prevent subsequent ignition. The excavator is particularly useful for rapidly forming a fire break by clearing a zone of flammable material adjacent a fire to prevent the fire from spreading.

As well as performing as a reservoir for fire fighting water, tank 11 also functions to ballast and stabilize the excavator to which it is mounted. This is particularly important in forest fire fighting environments where the ground over which the excavator is moving may be naturally uneven or may be covered with burnt or burning debris.

Tank 11 also serves to cover and protect the engine compartment of the excavator. The engine compartment with oil and gas lines is potentially ignitable by flying ash or other burning debris from a fire. The tank of the present invention provides a physical cover to protect the engine and the sprinkler system disposed in the engine compartment serves to prevent fires from developing and provides some additional cooling of the engine.

While specific embodiments of the invention have been described and illustrated, such embodiments should be considered illustrative of the invention only and not as limiting the invention as construed in accordance with the accompanying claims.

I claim:

1. A tank system mountable to an excavator vehicle having a frame and body with a hydraulically operated bucket and an engine, the tank system comprising:

a main body mountable to the frame adjacent the engine, the main body having a sealed interior volume;

at least one ballast region formed within the interior volume to hold fluid for ballast;

at least one discharge region formed within the interior volume to hold fluid for discharge from the tank;

at least one valve communicating the at least one ballast region with the at least one discharge region to permit one way flow from the ballast region to the discharge region;

a pump having an inlet in communication with the discharge region and an outlet; and a conduit extending from the pump outlet for delivering fluid forwardly of the excavator bucket.

2. A tank system as claimed in claim 1 including an additional conduit extending from the pump outlet for delivering fluid adjacent the engine.

3. A tank system as claimed in claimed 2 in which the additional conduit includes at least one sprinkler outlet for spraying fluid adjacent the engine.

4. A tank system as claimed in claim 1 in which the interior volume of the main body is formed with partition walls to define the ballast and discharge regions.

5. A tank system as claimed in claim 4 in which the main body is formed in cross-section as an inverted U with a central portion and downwardly extending legs, the legs being hollow and positionable on opposite sides of the engine and the central portion of the U being extendable over top the engine whereby the legs and central portion define the ballast region of the main body.

6. A tank system as claimed in claim 5 having an end portion extending between the downwardly extending legs to define the discharge region of the main body whereby the main body has an open central region positionable over the engine to enclose the engine at the top, sides and at one end.

7. A tank system as claimed in claim 5 including an opening through the central portion to permit access to the engine.

8. A tank system as claimed in claim 1 including a pivoting joint for pivotally mounting the tank to the frame of the excavator.

9. A tank system as claimed in claim 8 including an actuator extendable between the tank and the frame of the excavator to cause pivoting of the tank about the pivoting joint.

10. A tank system as claimed in claim 9 in which the actuator is a hydraulic cylinder.

11. A tank system as claimed in claim 1 in which the conduit extending from the pump outlet for delivering fluid forwardly of the excavator bucket is formed from rigid and flexible sections to accommodate movement of the excavator bucket, the conduit terminating at a nozzle to direct fluid under pressure.

12. A tank system as claimed in claim 11 in which the nozzle is mountable adjacent to the excavator bucket.

13. A tank system as claimed in claim 1 including a first inlet to the tank in communication with the at least one ballast region and a second inlet to the tank in communication with the at least one discharge region.

14. A tank system as claimed in claim 1 including an additional sealed region to retain a fire retardant material, the additional region including an outlet in communication with the conduit for delivering fluid forwardly of the excavator bucket to mix the fire retardant material with the fluid.

15. An improved excavator vehicle having a frame and body with a hydraulically operated bucket and an engine, the improvement comprising:

a tank system supported by the excavator having a main body mounted to the frame adjacent the engine, the main body having a sealed interior volume;

at least one ballast region formed within the interior volume to hold fluid for ballast;

at least one discharge region formed within the interior volume to hold fluid for discharge from the tank;

at least one valve communicating the at least one ballast region with the at least one discharge region to permit one way flow from the ballast region to the discharge region;

a pump having an inlet in communication with the discharge region and an outlet; and a conduit extending from the pump outlet for delivering fluid forwardly of the excavator bucket.

* * * * *